US007770532B2

(12) United States Patent
Bauduin et al.

(10) Patent No.: US 7,770,532 B2
(45) Date of Patent: Aug. 10, 2010

(54) DISCONNECTABLE RISER-MOORING SYSTEM

(75) Inventors: Christian Bauduin, Nice (FR); Benoit Borde, Nice (FR); Jean Braud, La Turbie (FR)

(73) Assignee: Single Buoy Moorings, Inc. (CH)

( * ) Notice: Subject to any disclaimer, the term of this patent is extended or adjusted under 35 U.S.C. 154(b) by 223 days.

(21) Appl. No.: 12/152,700

(22) Filed: May 16, 2008

(65) Prior Publication Data

US 2008/0311804 A1 Dec. 18, 2008

Related U.S. Application Data

(60) Provisional application No. 60/934,230, filed on Jun. 12, 2007.

(51) Int. Cl.
*B63B 21/00* (2006.01)

(52) U.S. Cl. ..... 114/230.2

(58) Field of Classification Search ..... 441/5; 114/230.2, 230.12, 293
See application file for complete search history.

(56) References Cited

U.S. PATENT DOCUMENTS 4,371,037 A * 2/1983 Arnaudeau ..... 166/366
5,044,297 A 9/1991 de Baan et al.
5,054,415 A 10/1991 Marshall
5,147,148 A 9/1992 White et al.
5,639,187 A * 6/1997 Mungall et al. ..... 405/195.1
5,678,503 A 10/1997 Poranski, Sr.
5,957,074 A 9/1999 de Baan et al.
6,021,848 A 2/2000 Breivik et al.
6,062,769 A * 5/2000 Cunningham ..... 405/195.1
6,811,355 B2 11/2004 Poldervaart
2006/0177273 A1 * 8/2006 Bonnemaire et al. ..... 405/211

* cited by examiner

*Primary Examiner*—Stephen Avila
(74) *Attorney, Agent, or Firm*—Leon D. Rosen

(57) ABSTRACT

A system is described for use at offshore locations of large depth, for mooring a production vessel or floating unit (14) at a location over a hydrocarbon reservoir (26) and for connecting risers (101) that can be carrying hydrocarbons up from the sea floor to a production vessel that stores the hydrocarbons, flowlines for water injection, gas lift, gas export, umbilicals and mooring lines that moor the vessel. Both the mooring lines and the risers are disconnectably connected to the vessel though a connection buoy, or connector (16). The invention concerns a system that allows a connector (16) to be used that is of minimum mass and volume, to ease its handling especially during its connection and disconnection to and from a vessel.

10 Claims, 10 Drawing Sheets

DISCONNECTABLE RISER-MOORING SYSTEM

CROSS-REFERENCE

Applicant claims priority from US Provisional Patent Application Ser. No. 60/934,230 filed 12 Jun., 2007.

BACKGROUND OF THE INVENTION

Hydrocarbons in an undersea reservoir lying at the bottom of a deep sea (over 500 meters) are commonly produced by an installation that includes risers for carrying the hydrocarbons up from the sea floor to a production vessel that stores the hydrocarbons. The connections to the sea floor can also include flowlines for water injection, gas lift, gas export, and umbilicals, and also mooring lines that moor the vessel. At times the vessel must sail away from a location over the region of the reservoir where the risers and mooring lines are located, as when a storm is approaching, or to carry the stored hydrocarbons to another station, or for another purpose. For this reason, the installation commonly includes a connection buoy, or buoyant connector that is connected to the upper ends of the risers and the upper ends of the mooring lines, and that is in turn, connected to the vessel in a manner that allows the connector to be disconnected and reconnected. When the connector is disconnected from the vessel, the connector sinks to a position that is at least 25 meters under the sea surface so the connector lies under most or all of the wave action zone.

When the vessel returns to the production installation, the connector must be raised and connected to the vessel by personnel on the vessel and/or divers. The less massive the connector, the easier it is to manipulate and move during disconnection and reconnection. The present invention is directed largely to making such installations so the connector is of minimum mass and volume and therefore easier to move, and so the connector is moved a minimum distance. The installations are used primarily for the production of hydrocarbons, but are useful wherever large quantities of hydrocarbons are to be transferred.

SUMMARY OF THE INVENTION

In accordance with one embodiment of the invention, an installation is provided for mooring a hydrocarbon transfer vessel that includes a buoyant connector that connects risers and mooring lines to a vessel, wherein the connector can be disconnected from the vessel to sink under much of the wave action zone, wherein the connector can be moved with minimum effort. The mooring lines have primarily vertical lower portions that extend up to mooring buoys and have upper portions that extend primarily horizontally from the mooring buoys to the connector. The risers have lower portions that extend from the sea floor up to riser buoy means, and the risers have upper portions in the form of jumper hoses that extend from the riser buoy means to the connector. In most cases, the riser buoy means are buoys that are separate from the mooring buoys, but in some cases the riser buoys are formed by the mooring buoys that also support the lower portions of the risers. According to the invention, the riser buoy means is not directly moored to the seabed, but is coupled to the mooring buoys. It should be noted that in this text, "coupled to the mooring buoys" includes attached to the mooring system in the vicinity of the buoy or to a junction element linked to the buoy.

There is no primarily vertical line or other weight-supporting connection between any riser buoy (or riser buoy means) and the buoyant connector. Flexible jumper hoses extend from the riser buoy to the connector, but the jumper hoses are buoyant in water and are too long and flexible to transfer weight from the riser buoy to the connector. As a result, the connector supports substantially only its own weight, and half of the weight of the jumper hoses. As a result, when the connector must be lifted from deep (e.g. 50 meters) under water to the vessel, the personnel must lift only the weight of the buoyant connector (minus its buoyancy), one end of each mooring line horizontal upper portion, and a portion of the jumper hoses of the risers.

The novel features of the invention are set forth with particularity in the appended claims. It should be understood that when referring to risers, applicant refers to risers carrying the hydrocarbons up from the sea floor to a production vessel that stores the hydrocarbons, as well as flowlines for water injection, for gas lift, for gas export (when needed) and umbilicals. The invention will be best understood from the following description when read in conjunction with the accompanying drawings.

DESCRIPTION OF THE PREFERRED EMBODIMENTS

Figure 1A:
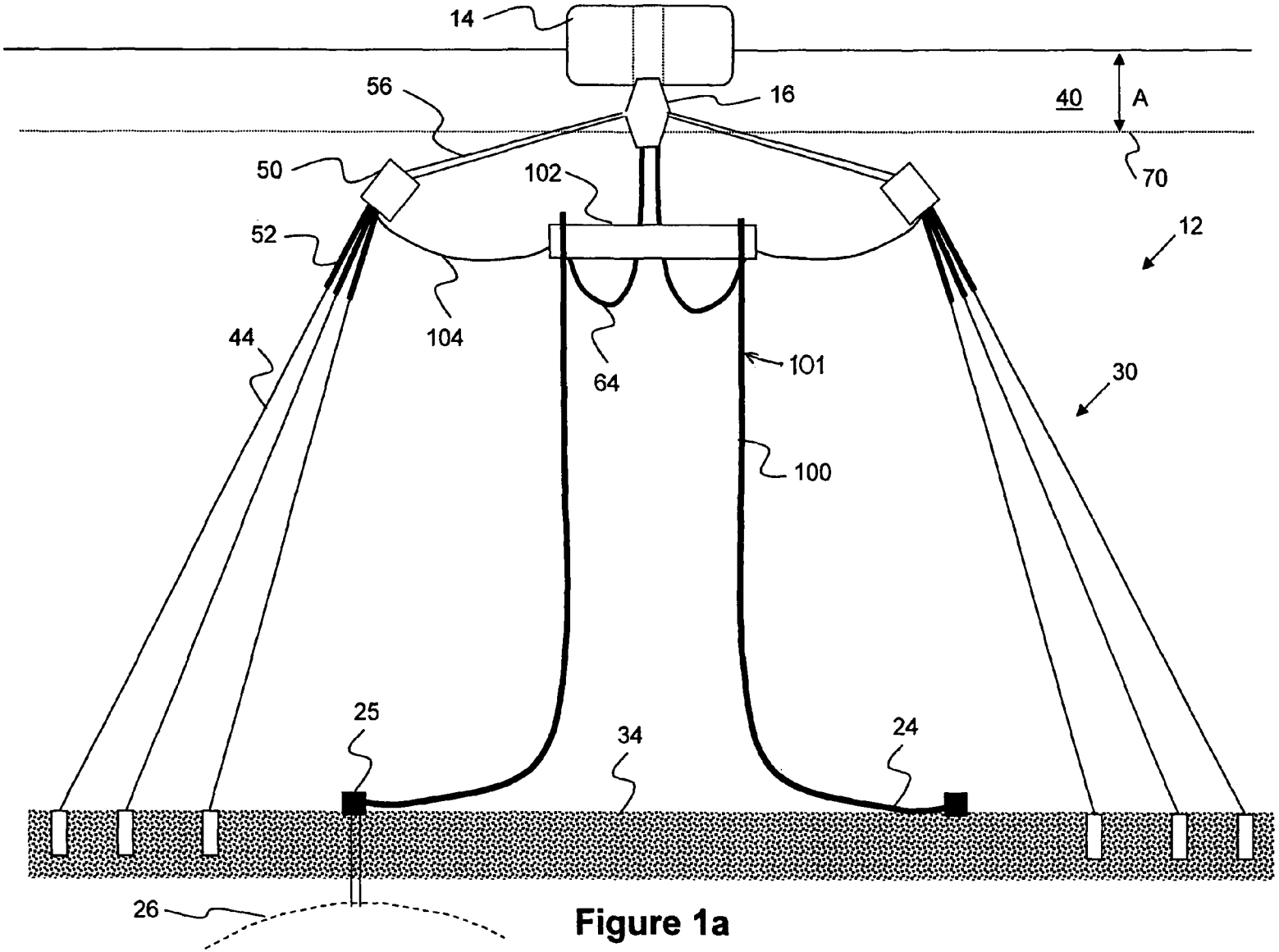
FIG. 1*a* is a side elevation view of a vessel and a hydrocarbon transfer installation of the invention, with the connector of the installation connected to the vessel.

FIG. 1*a* illustrates a system 12 for mooring a vessel 14 such as an FPSO (floating, production, storage, and offloading) through a disconnectable turret buoy, or connection buoy, or buoyant connector 16. The system includes risers (production lines, lines for water injection, gas lift, umbilicals) 101 whose lower ends 24 lead to well heads 25 that connect to a subsea hydrocarbon (oil and/or gas) reservoir 26, and also includes mooring assemblies 30 that hold the vessel in position. The risers 101 and mooring or anchor assemblies 30 have upper ends connected to the connection buoy 16, and lower ends connected to the sea floor 34. Thus, all major connections of the vessel to the sea floor are made though the connection buoy 16. There is no primarily vertical tensioned line that extends from the riser buoy 102 to the seabed 34. The vessel sometimes sails away from the location over the reservoir, as when a large storm or iceberg is approaching, or if the vessel sails to a location where it unloads the hydrocarbons it has collected and stored. In those cases, the connection buoy 16 must be disconnected from the vessel 14 and allowed to sink to a height that is preferably below the bottom 70 of a wave action zone 40 of height A, and later picked up and reconnected to the vessel 14.

During disconnection and reconnection of the connection buoy 16, the buoy must be handled by personnel on the vessel and/or divers. The less massive the connection buoy, the easier it is to manipulate it and move it during such operations. The present invention is directed to designing the system so a connection buoy of minimal mass and volume can be used to reliably connect and disconnect the mooring and riser parts of the system to the vessel.

The mooring assemblies 30 include lines preferably made of steel wire or polyester ropes or combinations thereof which are of less weight than long steel chain mooring lines. Steel has a specific gravity of about 7 and if long steel chains were used their upper ends would have to be supported by a relatively large vessel or large buoy.

FIG. 1*a* also shows that the vessel has a turret that allows the vessel to weathervane, and that the buoyant connector 16 is connected to the bottom of the turret. A majority of the height of the connector 16 lies under the turret. The bottom of the vessel hull lies about 20 meters below the sea surface for the installation illustrated, and the top of the connector lies about 3 meters above the vessel hull bottom. As a result, the connector moves down about 33 meters in order to lie under the wave active zone 40 (which extends to about 50 meters under the sea surface, or to a depth between 25 and 75 meters under the sea surface), and the connector must be lifted about 33 meters in order to reconnect it to the vessel. If the connector lay fully in the vessel, then it would have to be moved up from a greater depth that is about 7 meters deeper for reconnection. In particular cases such as in seas where there are icebergs, the connector can move down about 100 meters in order to lie under icebergs.

A spring buoy 50 (a buoy with springs extending down from the buoy) is shown in FIG. 1*a* lying under the wave action zone 40, and is attached to the upper end of each primarily vertical lower mooring line parts 44. Short lengths 52 of steel chain extend from the spring buoy to each lower line part 44. Two or more primarily horizontal upper polymer or polymer-and-steel cable line parts 56, which constitute upper mooring line parts, extend from the spring buoy to the connection buoy 16. Applicant prefers to use at least two upper line parts for redundancy reasons, so to ensure continued mooring even if one upper mooring line part breaks.

FIG. 1*a* also shows risers 101 formed by steel catenary riser (SCR) lower riser parts 100 and flexible jumper hoses 64, with a common riser buoy 102 connected by primarily horizontal lines 104 to the spring buoys or mooring buoys 50. The riser buoy 102 lies closer to the sea surface than to the sea floor. The riser buoy 102 is not directly moored to the seabed but follows the movements and displacements of the spring buoys 50, as they are interconnected. The common riser buoy 102 could also refer to a bundle of several smaller buoys (as shown in FIG. 1*b*), one buoy supporting one riser lower part 100.

Further, it can be seen in FIG. 1*a* that the connection buoy 16 supports one end of each of the primarily horizontal upper mooring line parts 56. These mooring line parts 56 have a specific gravity only moderately greater than water. The connector buoy 16 also supports some of the weight of the riser upper portions that are formed by the jumper hoses 64. The jumper hoses are very flexible and do not support any weight other than their own weight. There is no primarily vertical weight-supporting line that extends from the common buoy 102 to the seabed. As there is no tensioned line between the buoyant connector 16 and the common buoy, or riser buoy means 102, the common buoy 102 is not moved up or down appreciably (by at least 10% of common buoy vertical movement) when the connector is moved vertically. Thus, when the disconnected connector 16A of FIG. 1*c* must be reconnected to the vessel 14, personnel have to lift and manipulate the mass of the connector 16A, the mass of about half the weight in water of the upper mooring line parts 56A, and a part of the mass of the jumper hoses 64A. When the connector 16A is lifted, it does not lift the common buoy 102A or the weights of the riser lower portions 100A that hang from the buoy 102A.

Figure 1B:
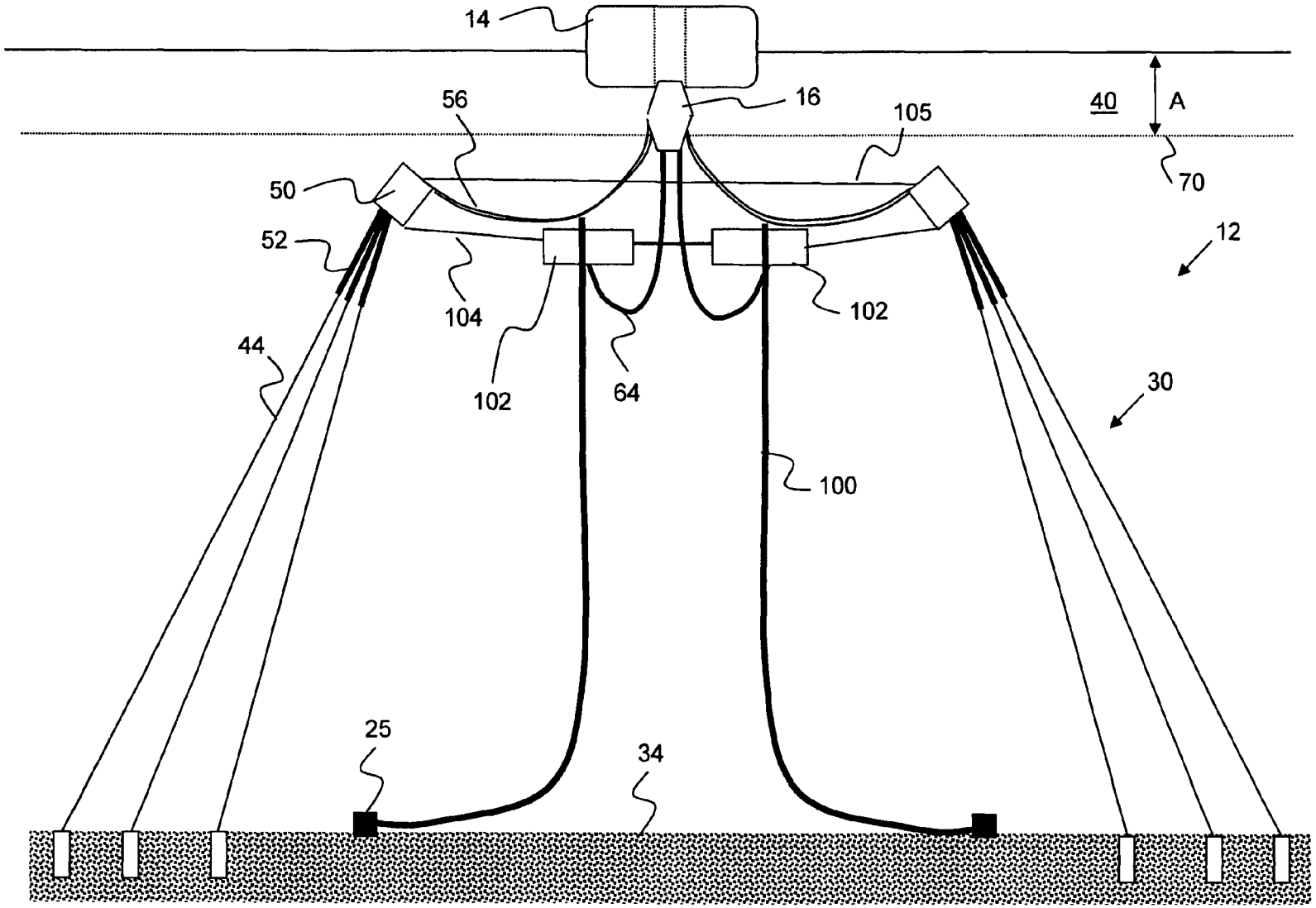
FIG. 1*b* is a side elevation view of an installation that differs from that of FIG. 1*a* in that the mooring buoys are more tightly coupled to the riser buoys but less tightly coupled to the connector.

FIG. 1*b* shows an alternative embodiment, where the mooring buoys 50 are connected to the common buoy via taut lines 104, and the common buoy is a bundle of small buoys 102, with one small buoy per riser 100. In this configuration the pretension is shared between the mooring lines lower parts 44 and the primarily horizontal taut lines 104 that extend between the mooring buoys 50 and the small buoys 102. The upper mooring line parts 56 do not have any net tension (other than that caused by their weight in water). The mooring buoys 50 could also be connected one to the other via a taut line 105 in addition to lines 104 (for redundancy or when there are no risers). In this configuration the mooring line upper parts 56 are very light and slack, so the mooring line weight supported by the connector buoy 16 is small. Hence, it creates an artificial water depth and hence the mooring line upper parts 56 and the jumper hoses 64 are independent from the pretension applied on the system, the connector 16 moving with jumpers 64 and the mooring lines upper parts 56. The artificial water depth enables applicant to use upper mooring line parts 56 and jumper hoses 64 of short length which minimizes the suspended weight. Therefore, the design of the connector buoy can be simplified as it is less buoyant, smaller and lighter.

Figure 1C:
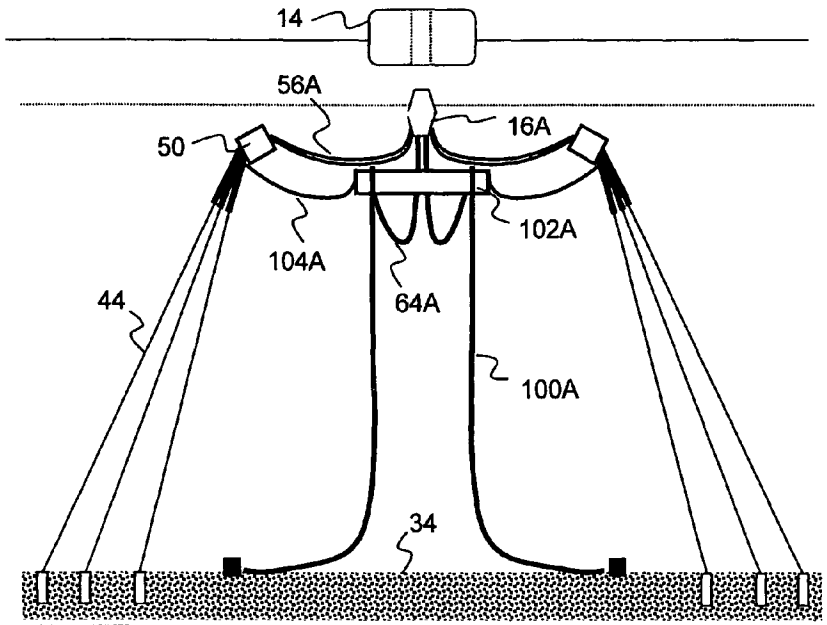
FIG. 1*c* is a view similar to that of FIG. 1*a*, but with the connector disconnected from the vessel and lying under the wave active zone.

FIG. 1*c* shows the system of FIG. 1*a* when the connection buoy 16A has been disconnected from the vessel. The buoy 16A is buoyant, while the upper line parts 56A and jumper hoses 64A connected to the buoy tend to sink in water. As the buoy sinks, it supports smaller portions of the jumper hoses 64A until the buoy reaches a stable depth. It should be noted that all weight-carrying upper parts of the mooring system and the fluid transfer system are horizontally coupled so they all tend to move horizontally together. Thus, when the connection buoy at 16 or 16A is horizontally displaced, the spring buoys 50 and riser buoy 102 will be horizontally displaced, because they all are horizontally coupled.

Figure 1D:
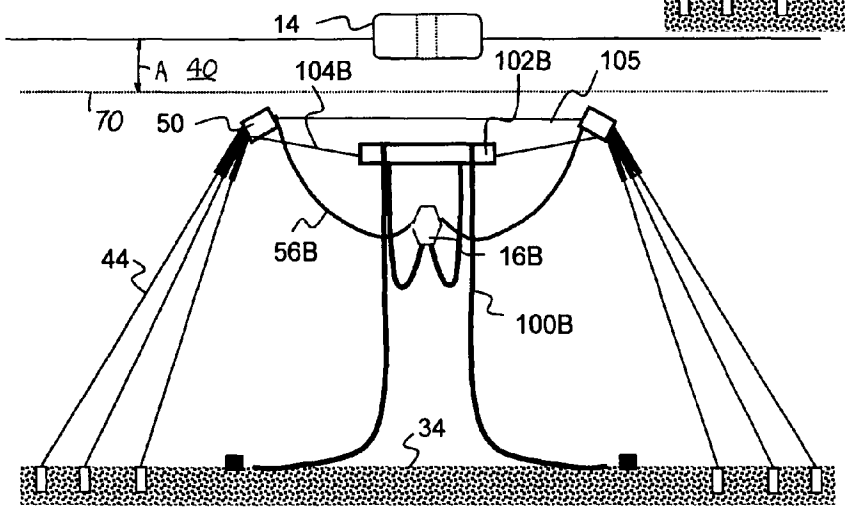
FIG. 1*d* is a view similar to that of FIG. 1*b*, but with the connector disconnected from the vessel and lying under the wave active zone.

FIG. 1*d* shows the system of FIG. 1*b* when the connection buoy 16B has been disconnected from the vessel. Once disconnected, the connector at 16B lies underneath the riser buoy 102B and the mooring buoys 50. Thanks to this configuration the relative movement of riser lower portions 100B is decreased. In FIG. 1*d*, the spring buoys 50 and riser buoy 102B will be horizontally displaced, because they all are horizontally coupled via taut lines 104B and 105. Further, as the configuration of FIG. 1*b* enables a vertical decoupling of the connector 16B and the buoys (50, 102B), it creates an artificial water depth, the relative movement of riser lower portions 100 is decreased and the connector supporting portions of the jumper hoses 64B and mooring lines upper parts 56B will reach a stable depth, which is deeper than the one of the configuration of FIG. 1*a* shown sunk in FIG. 1*c*. A deeper depth of connector 16B occurs because buoys 50 do not move further apart as the connector 16B moves down.

Applicant places the interconnected spring buoys 50 and riser buoys 102B of FIG. 1*d* closely under the wave action zone 40, and preferably with their center placed less than the distance A below the bottom 70 of the zone.

Figure 2:
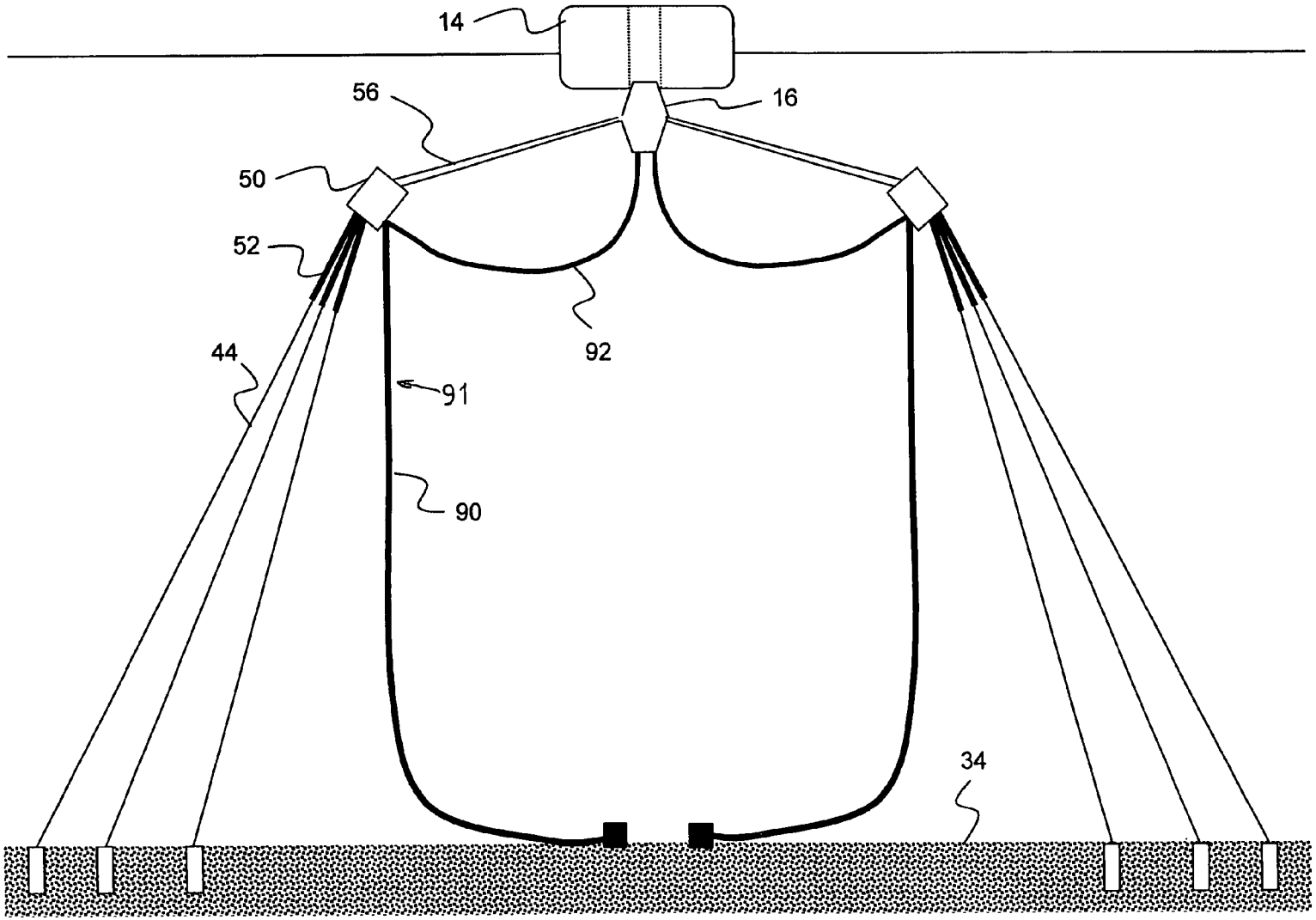
FIG. 2 is a side elevation view of a vessel and installation of another embodiment of the invention, wherein the mooring buoys serve as buoy means that also support the risers.

FIG. 2 shows risers 91 with steel catenary riser lower parts 90 that extend up to the spring buoys 50 and jumper hoses 92 that extend to the connection buoy. In the system of FIG. 2, the hoses that form upper portions of the risers are connected to spring mooring buoys 50 to be supported. The systems of FIGS. 1*a* and 1*b* and FIG. 2 can be used with steel catenary risers 91, 101 and also can be used with flexible risers and umbilicals.

In FIG. 2 the mooring buoys 50 that keep the lower mooring line parts 44 taut and that support one end of each upper mooring line part 56 are part of riser buoy means that also supports one end of each jumper hose 92. This avoids the need for at least one additional buoy.

Figure 3:
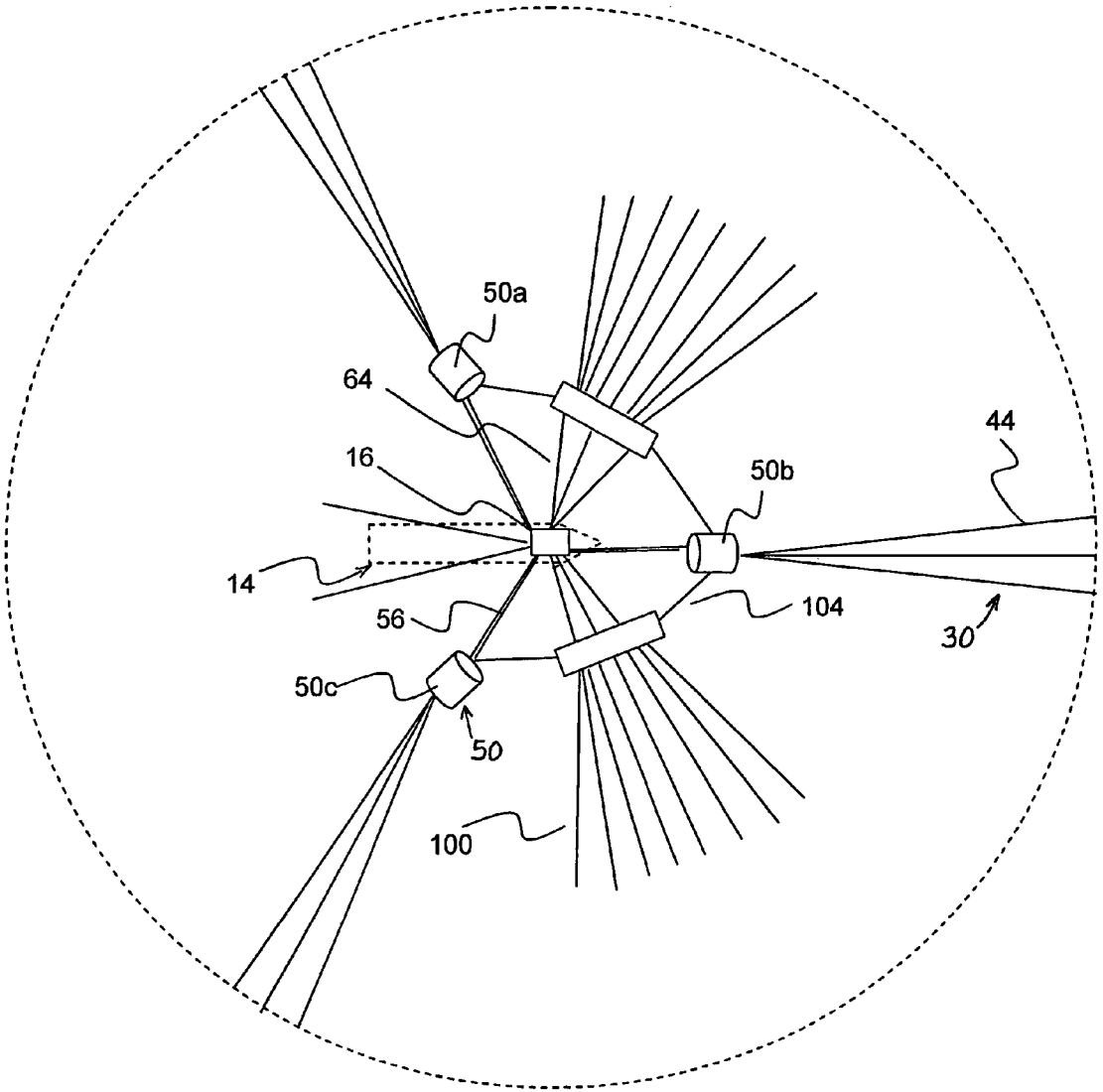
FIG. 3 is a plan view of the vessel and installation of FIG. 1*a*.

FIG. 3 shows a top view of the vessel 14 and the system 12, with the vessel shown in phantom lines. The particular illustrated system has three sets of mooring assemblies 30 angled 120° apart that each includes three primarily vertical line lower parts 44 made of steel wires or polyester ropes. For each set, applicant provides a plurality (preferably at least three) of vertical line lower parts 44 extending at slightly different (typically about 4°, that is, at 2° to 8°) compass headings. This provides redundancy to assure that there will be adequate mooring even if one of three lower mooring lines breaks or its foundation is damaged.

It is clearly shown that the risers and the riser buoys 102 lie in between the 120 degrees-separated mooring assemblies 30. FIG. 3 shows that the riser buoys 102 and the spring buoys 50 are interconnected. (For the embodiment described in FIG. 1*b* a connection line 105 can be added, in addition to lines 104, between the mooring buoys 50).

Mooring lines made partly of polyester materials are advantageous to minimize the weight that must be supported in deep waters (e.g. over 500 meters). In fact, polyesters materials have specific gravities of 1.1 to 1.4 so they require only a relatively light support.

Figure 4:
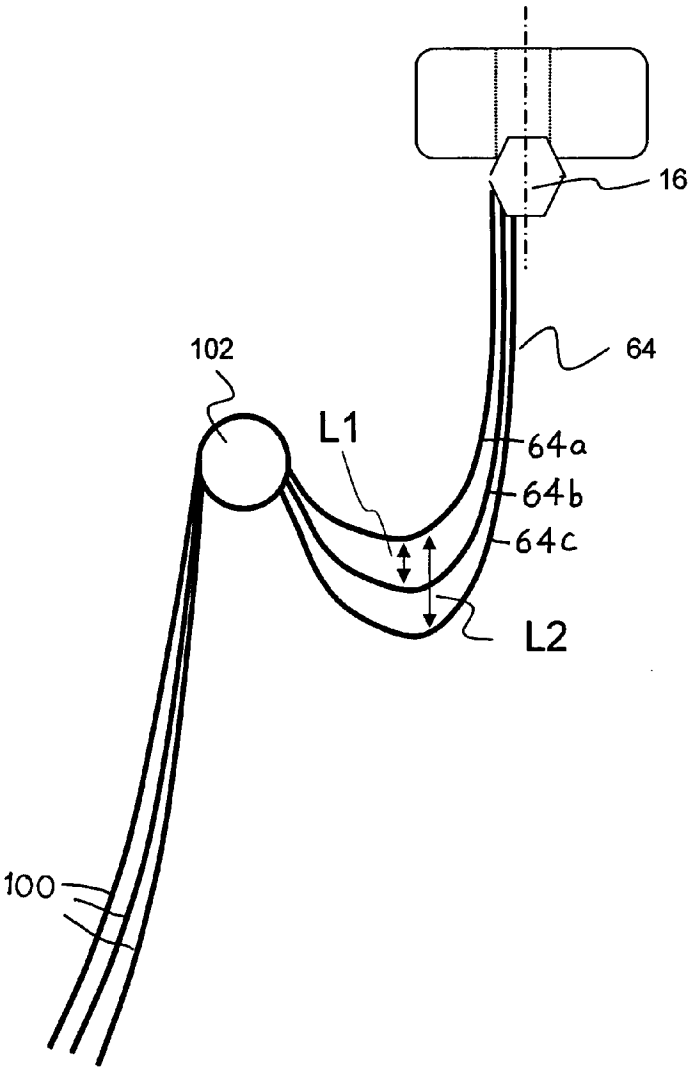
FIG. 4 is an end elevation view of a portion of the installation of FIGS. 1*a* and 1*b*.

FIG. 4 shows a side view of the configuration of a buoy 102, jumper hoses 64, and attached riser lower parts 100 of FIGS. 1*a*, 1*b* and 3. The jumper hoses 64 each extends in a catenary curve and have different lengths so as to avoid congestion. The lowest jumper hose 64*c* of FIG. 4 has a length about 20% (10% to 35%) greater than the upper hose 64*a*. This results in a vertical separation L1 between the uppermost and middle hose 64*b* and a separation L2 between the uppermost and lowermost hoses. The difference between lengths of adjacent hoses is preferably at least 5% and is preferably no more than 15%. As there is only a limited horizontal space in the congested area between the mooring lines near the vessel, the distances between the jumper hoses is primarily vertical by variation of the length of each jumper hose. This avoids the jumper hoses rubbing against each other in the limited and congested space between the mooring lines, which usually lies in the wave active zone. Each jumper hose extends in a J-curve, with a primarily vertical portion extending down from the connector 16, and with a large curve extending down from the primarily vertical portion 100 and up to the buoy 102. An alternative would be to have jumper hoses extending in a wave curve or S curve when the jumper is not buoyant.

FIGS. 5-8 show additional possible features of the invention with risers 20 each including a rigid lower riser part 60 that extends up from the sea floor to a riser buoy 62, and a flexible upper riser part, or jumper hose 64 that extends in a catenary curve up to the connection buoy 16.

Figure 5:
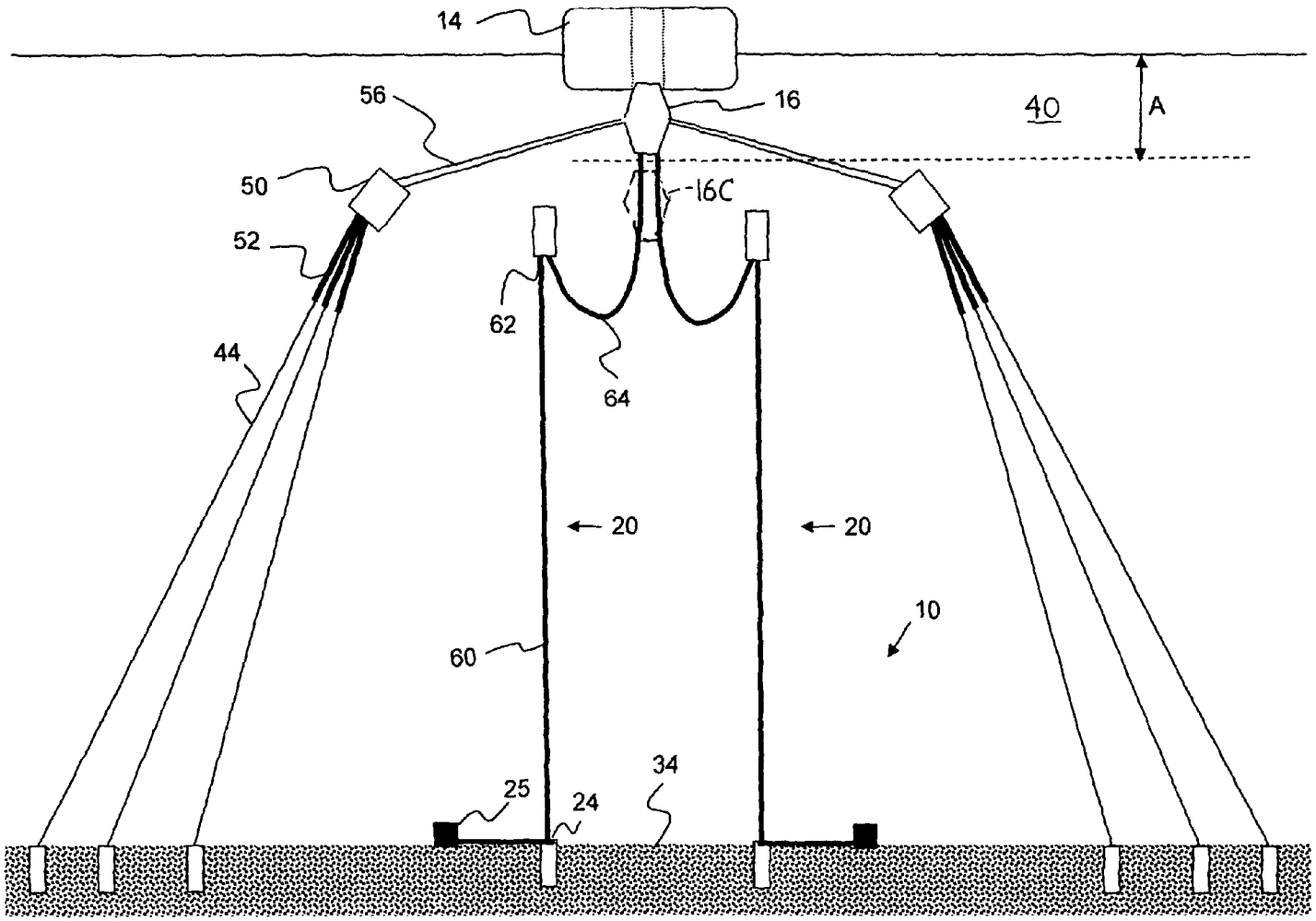
FIG. 5 is a side elevation view of a vessel and installation of another embodiment of the invention wherein each riser (or group of risers that extend close together up from the sea floor) has a taut lower portion and the top of its lower riser portion is supported by a separate riser buoy.

FIG. 5 shows an installation similar to that of FIG. 1*a*, except that a separate riser buoy 62 is used to support each riser lower part 60. This allows each lower riser part to extend tautly in a straight line that is primarily vertical, from the sea floor up to a buoy 62, instead of having each riser lower part extend in a curve. The installation is otherwise similar to that of FIG. 1*a* except that no stabilization line extends from the mooring buoys 50 to the riser buoys 62. In FIG. 5 each riser buoy 62 is placed to lie a short distance under the wave action zone 40, with the distance (to the middle of each buoy 12) preferably being no more than the height A of the wave action zone. A typical wave action zone has a height of 50 meters, which is of the same order of magnitude as the height of about 35 meters of the particular FPSO vessel 14. When disconnected from the vessel, the connection buoy 16 should lie at least 25 meters under the sea surface to lie under the upper half of the wave zone, where water movement is greatest, and preferably should lie under the entire wave zone height of about 50 meters (or even deeper if icebergs need to be avoided). FIG. 5 also shows the connection buoy at 16C after it has been disconnected from the vessel. The connection buoy 16 is buoyant, while the mooring upper line parts 56 and jumper hoses 64 connected to the buoy tend to sink in water, so the buoy moves down until its buoyancy equals the downward weight on it of the parts 56 and jumper hose 64 (and tension forces of upper line parts 56).

Figure 6:
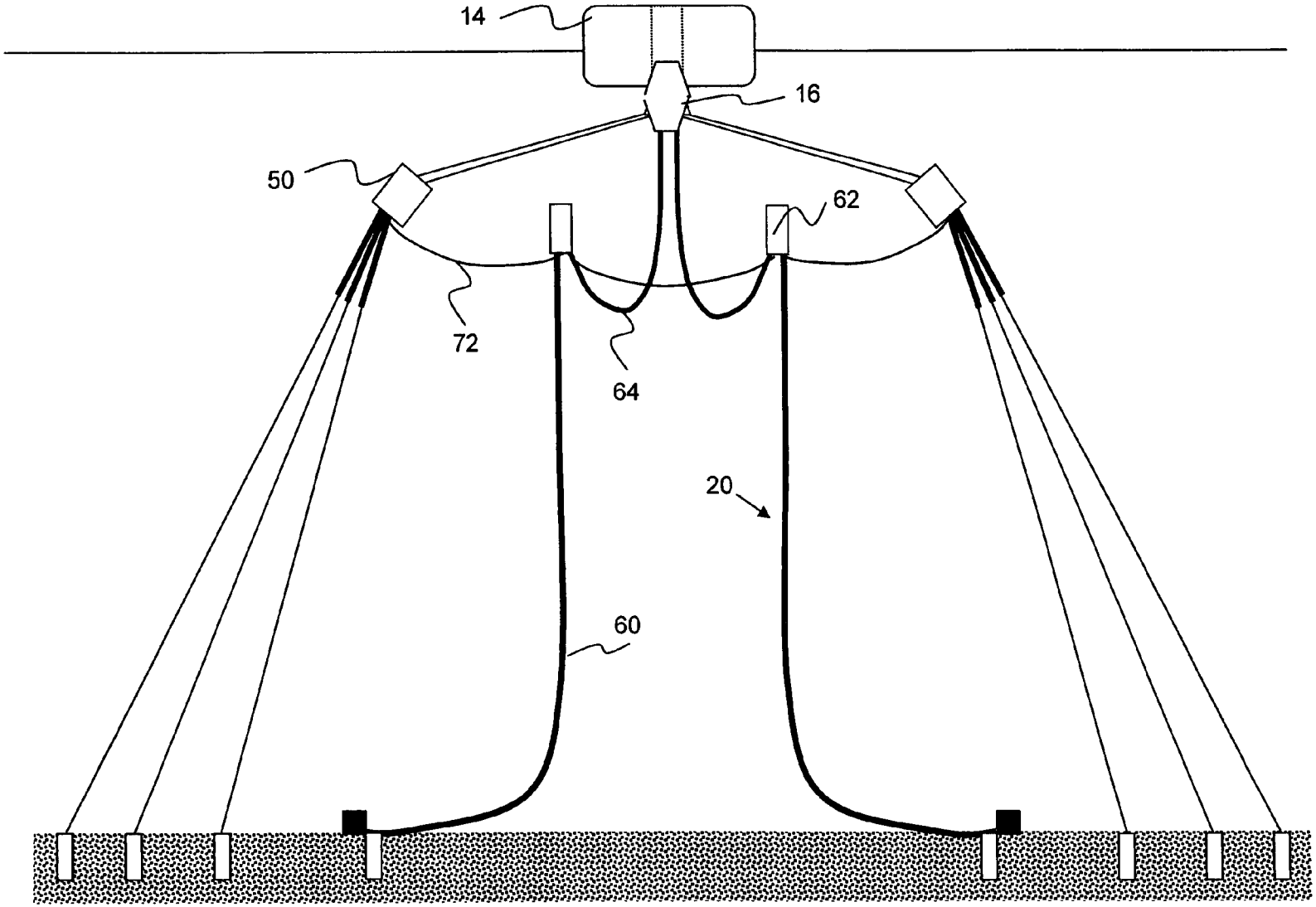
FIG. 6 is a side elevation view of a vessel and installation similar to that of FIG. 5, but with primarily horizontal tether lines extending between each mooring buoy and riser buoy and between the riser buoys, and the riser lower portions have a catenary shape.

FIG. 6 shows an installation similar to that of FIG. 5, except that a primarily horizontal stabilization line 72 extends from each mooring buoy 50 to each riser buoy. A stabilization line such as a cable or chain 72 extends between each spring buoy and a riser buoy, to reduce their relative horizontal movements. This stabilization line is needed as the system has catenary lower riser parts 60 instead of taut vertical lower riser parts.

Figure 7:
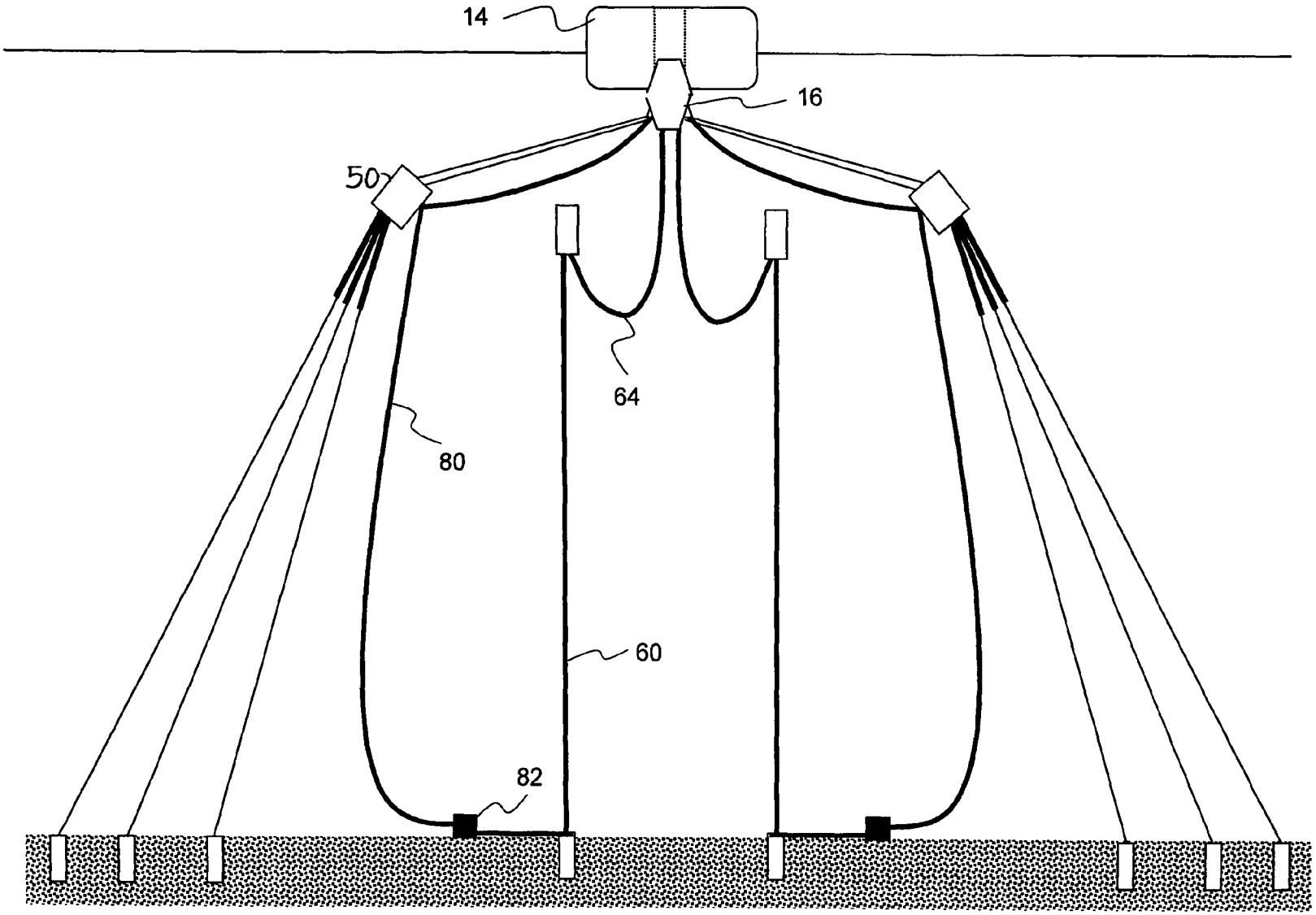
FIG. 7 is a side elevation view of a vessel and installation which combines the systems of FIGS. 2 and 5, with some of the riser lower portions supported by the mooring buoys and some of the riser lower portions supported by separate riser buoys.

FIG. 7 shows an installation that combines the systems of FIGS. 2 and 5, with some riser lower parts 80 each extending to a spring buoy which also serves as a riser buoy means, and with some risers each extending to a separate riser buoy. In FIG. 7, an umbilical riser lower part 80 is provided that extends from the connection buoy 16 to each spring buoy 50 and from there to the well head 82 to carry tools.

Figure 8:
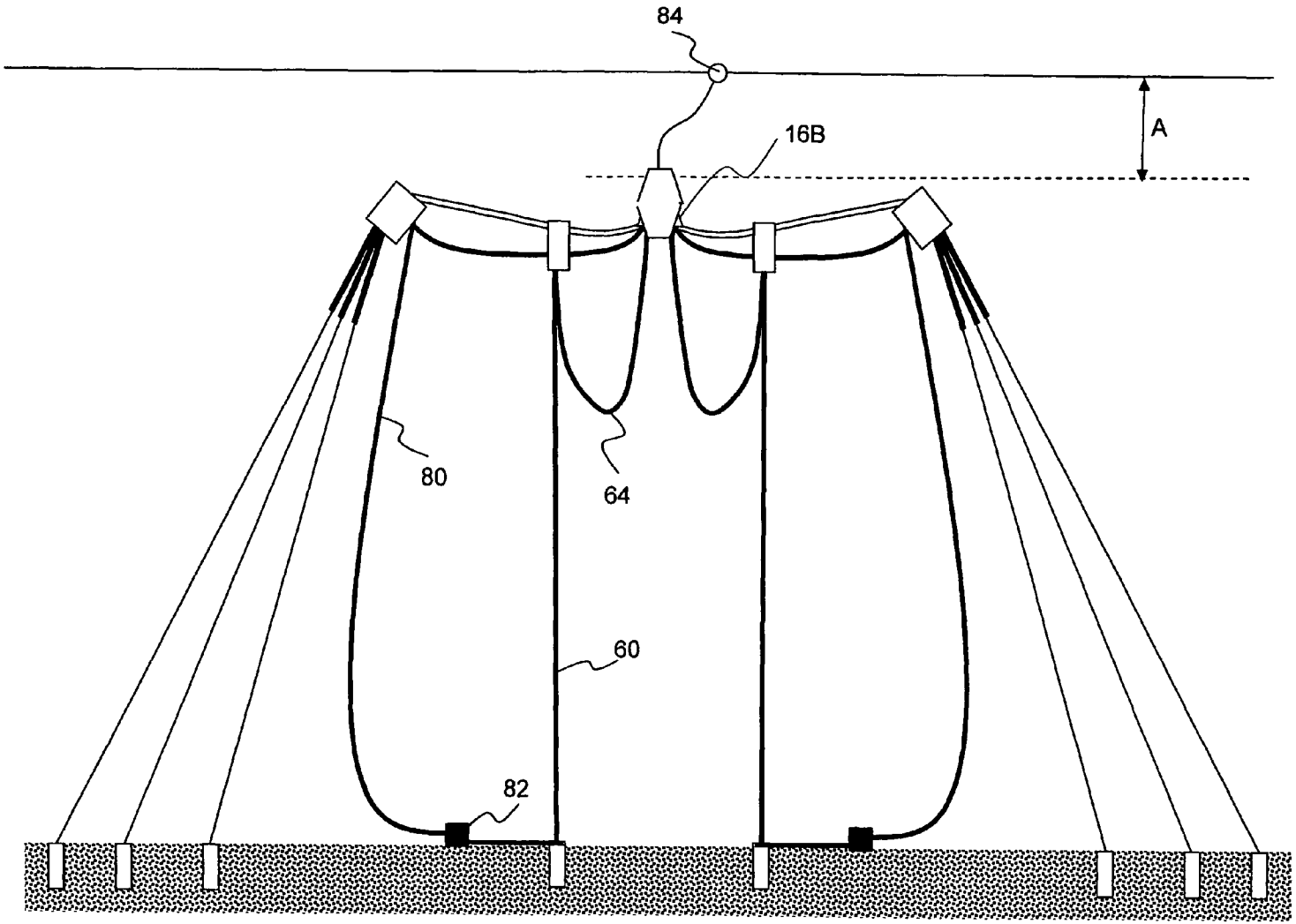
FIG. 8 is a side elevation view of the system of FIG. 7 but with the connector detached from the vessel and lying deep underwater.

FIG. 8 shows the installation when the connector 16 is connected and sinks to a height below (its center is below) the wave active zone. It shows the system of FIG. 7 with the connection buoy at 16B released to sink while a pickup buoy 84 remains at the surface.

The systems shown in FIGS. 5, 7 and 8 also can be provided with stabilization lines between the secondary buoys 50, 62, depending on environmental conditions. When the connection buoy 16 (e.g. FIG. 5) is disconnected, the mooring buoys 50 and riser buoys 62 will support any additional weight of the upper mooring line parts 56 and jumper hoses 64. Both spring buoys 50 and riser buoys 62 are designed to take this weight variation between the connected and disconnected positions of the connection buoy 16.

Thus, the invention provides an improved installation that includes a connector buoy, or connector that connects mooring lines and risers to a vessel. The mooring lines have lower parts that extend primarily vertically to mooring buoys and have primarily horizontal upper parts that extend primarily horizontally to the connector to hold the vessel from drifting far away from a central location. The risers have lower parts that extend primarily vertically up to riser buoy means that may comprise a common buoy, individual buoys, or the mooring line buoys, and flexible jumper hoses that extend up to the connector. There is a vertical decoupling between the riser buoy means and the connector, or between any of the riser buoys or mooring buoys so the connector would not cause the riser buoy or mooring buoy to move appreciably vertically (more than 10% of connector vertical movement) with the connector. This minimizes the mass that has to be moved up when the connector is lifted for reconnection to the vessel.

The connector usually, but not always lies above the riser buoys (see embodiment shown in FIG. 1*d*) when the connector is disconnected. The connector is connected to the lower riser part and to the riser buoy, by a flexible jumper hose that extends in a J-curve, so the jumper hose extends down from the connector to a height below the riser buoy and then extends in a curve up to the riser buoy.

The figures only show embodiments where the floating unit is a vessel such as an FPSO but it can also be any type of vessel (Floating storage and offloading unit (FSO), Floating storage and regassification unit . . . ) and any type of floating unit such as SPARs and floating production units (FPU).

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore fluid transfer system which includes a floating unit, a connection buoy (16), or buoyant connector, that is connectable and disconnectable from the floating unit, a plurality of risers that each extends from the sea floor to the connection buoy, and a plurality of mooring line assemblies that each extends from the sea floor to the connection buoy, including:

a plurality of mooring buoys (50) each lying closer to the sea surface than to the sea floor, each mooring line having a lower mooring line part (44) that extends up from the sea floor to one of said mooring buoys and an upper mooring line part (56) that extends primarily horizontally from the corresponding mooring line buoy to said connection buoy;

a riser buoy (102) lying closer to the sea surface than the sea floor and that is buoyant in water for supporting a portion of each of said risers, said risers each having a riser lower part that extends from the sea floor to said riser buoy, and having a riser upper part that extends from the riser buoy to the connection buoy, said connection buoy being disconnectable from said floating unit and then supports the upper ends of said mooring lines and of said risers.

2. The system described in claim 1 wherein:

said floating unit includes a turret, said connection buoy has a height, and a majority of the height of said connector buoy lies under said turret, to minimize the height that the connection buoy has to be lifted during reconnect.

3. The system described in claim 1 wherein:

said riser buoy means comprises a common buoy with said plurality of risers all supported by said common buoy and with each riser having a separate flexible jumper hose;

said jumper hoses are arranged with the bottom of each extending in a catenary curve and with said catenary curves of the jumper hoses being vertically spaced apart.

4. An offshore fluid transfer system which includes a floating unit, a buoyant connector that is connectable and disconnectable from the floating unit, a plurality of risers that each extends from the sea floor to the connector, and a plurality of anchor lines that each has a lower anchor line portion that extends from the sea floor to an anchor buoy and an upper anchor line portion that extends from the anchor buoy to the connector, including:

riser buoy means that is buoyant and that lies under said connector and closer to the sea surface than the sea floor, said plurality of risers each has a riser lower part that extends from the sea floor to said riser buoy means, and has a riser upper part that extends from the height of the riser buoy means to the connector;

taut lines extending primarily horizontally and connecting the mooring buoys with the riser buoy means, so the upper anchor line portions are not taut and therefore the connector is not biased downward by the upper anchor line portions.

5. The system described in claim 4 wherein:

said system is free of a weight transfer connection to said connector from said anchor buoy and from said riser buoy means, so when the buoyant connector is connected to the floating unit the connector does not support the anchor buoy or riser buoy means.

6. The system described in claim 4, wherein:

said sea has a wave active zone that extends a predetermined distance of about 50 meters under the sea surface, and a middle of said connector lies no higher than the bottom of said wave active zone when disconnected from the floating unit;

said floating unit has a hull with a bottom;

said connector lies with a part of its height under said hull bottom when the connector is connected to the floating unit, to thereby reduce the height of vertical movement of the connector.

7. An offshore fluid transfer system which includes a floating unit, a connection buoy, or buoyant connector, that is connectable and disconnectable from the floating unit, a plurality of risers that each extends from the sea floor to the connection buoy, and a plurality of mooring lines that each extends from the sea floor to the connector, including:

a plurality of mooring buoys, each mooring line having a lower mooring line part that extends up from the sea floor to one of said mooring buoys and an upper mooring line part that extends from the corresponding mooring line buoy to said connection buoy;

riser buoy means that is buoyant in water for supporting a portion of each of said risers, said risers each having a riser lower part that extends from the sea floor to said riser buoy means, and having a riser upper part that extends from the riser buoy means to the connection buoy;

said mooring buoys are each connected by a primarily horizontal line to said riser buoy means.

8. A system described in claim 7, wherein:

said primarily horizontal line is taut, to position the mooring buoy closer to the riser buoy means and thereby shorten the length of jumpers and/or upper mooring line parts.

9. An offshore fluid transfer system which includes a floating unit, a connection buoy, or buoyant connector, that is connectable and disconnectable from the floating unit, a plurality of risers that each extends from the sea floor to the connection buoy, and a plurality of mooring lines that each extends from the sea floor to the connector, including:

a plurality of mooring buoys, each mooring line having a lower mooring line part that extends up from the sea floor to one of said mooring buoys and an upper mooring line part that extends from the corresponding mooring line buoy to said connection buoy;

riser buoy means that is buoyant in water for supporting a portion of each of said risers, said risers each having a riser lower part that extends from the sea floor to said riser buoy means, and having a riser upper part that extends from the riser buoy means to the connection buoy;

said riser buoy means comprises a plurality of riser buoys that are spaced from said mooring buoys; and including a plurality of primarily horizontal stabilization lines each extending from one of said mooring buoys to one of said riser buoys.

10. An offshore fluid transfer system which includes a floating unit, a connection buoy, or buoyant connector, that is connectable and disconnectable from the floating unit, a plurality of risers that each extends from the sea floor to the connection buoy, and a plurality of mooring lines that each extends from the sea floor to the connector, including:

a plurality of mooring buoys, each mooring line having a lower mooring line part that extends up from the sea floor to one of said mooring buoys and an upper mooring line part that extends from the corresponding mooring line buoy to said connection buoy;

riser buoy means that is buoyant in water for supporting a portion of each of said risers, said risers each having a riser lower part that extends from the sea floor to said riser buoy means, and having a riser upper part that extends from the riser buoy means to the connection buoy;

said riser buoy means is formed by said plurality of mooring buoys, with each of said risers supported by one of said mooring buoys.

* * * * *